US007681497B2

(12) United States Patent
Kymäläinen et al.

(10) Patent No.: US 7,681,497 B2
(45) Date of Patent: Mar. 23, 2010

(54) METHOD AND APPARATUS FOR CHARGING AND DISCHARGING A CYCLE PRESS WITH A BOARD

(75) Inventors: Petri Kymäläinen, Nastola (FI); Iiro Nurminen, Helsinki (FI)

(73) Assignee: Raute Oyj, Nastola (FI)

( * ) Notice: Subject to any disclaimer, the term of this patent is extended or adjusted under 35 U.S.C. 154(b) by 184 days.

(21) Appl. No.: 11/568,298

(22) PCT Filed: Apr. 30, 2004

(86) PCT No.: PCT/FI2004/000263

§ 371 (c)(1),
(2), (4) Date: Oct. 25, 2006

(87) PCT Pub. No.: WO2005/105399

PCT Pub. Date: Nov. 10, 2005

(65) Prior Publication Data

US 2007/0216066 A1 Sep. 20, 2007

(51) Int. Cl.
*B30B 13/00* (2006.01)
*B30B 15/30* (2006.01)
*B30B 15/32* (2006.01)

(52) U.S. Cl. ..... 100/35; 100/215; 100/218; 100/326; 271/85; 271/196; 271/267

(58) Field of Classification Search ..... 100/35, 100/38, 138, 139, 140, 196, 207, 215, 218, 100/315, 325, 326; 72/405.09, 405.1, 405.11, 72/405.12, 405.13, 405.14, 405.16; 156/362, 156/394, 379.8, 391, 538, 539, 580, 583.1; 248/363; 198/621.1; 414/751.1, 752.1
See application file for complete search history.

(56) References Cited

U.S. PATENT DOCUMENTS

| | | | | |
|---|---|---|---|---|
| 3,977,535 | A * | 8/1976 | Husges et al. | 156/538 |
| 4,253,891 | A * | 3/1981 | Brussel | 156/60 |
| 4,348,252 | A * | 9/1982 | Knoop et al. | 156/538 |
| 4,424,092 | A | 1/1984 | Salenz | |
| 5,019,206 | A | 5/1991 | Bielfeldt | |
| 6,451,138 | B2 * | 9/2002 | Salenz et al. | 156/60 |

FOREIGN PATENT DOCUMENTS

| | | |
|---|---|---|
| DE | 197 18 866 | 11/1998 |
| EP | 0 908 282 | 4/1999 |
| SE | 510702 | 6/1999 |
| WO | WO 90/09873 | 9/1990 |

OTHER PUBLICATIONS

International Search Report No. PCT/FI2004/000263, dated Dec. 7, 2004, 2 pages.

* cited by examiner

*Primary Examiner*—Jimmy T Nguyen
(74) *Attorney, Agent, or Firm*—Connolly Bove Lodge & Hutz LLP

(57) ABSTRACT

The invention concerns a method for feeding and removing a board to/from a gap of a periodically operating press. The board to be pressed is fed grip-supported to the gap of the press from one side and a board pressed in the previous operating cycle is removed grip-supported from the same or from the opposite side during the opening cycle of the press. The movement feeding the board to the press and the movement removing the board from the press are performed at least partially staggered with each other.

2 Claims, 3 Drawing Sheets

METHOD AND APPARATUS FOR CHARGING AND DISCHARGING A CYCLE PRESS WITH A BOARD

This application is a National Phase of PCT/FI2004/000263, filed Apr. 30, 2004.

BACKGROUND OF THE INVENTION

1. Field of the Invention

The present invention concerns a method for removing a pressed board from the gap of a periodically operating press and for feeding a new board to be pressed to the gap of the press, whereby the removal of the pressed board and the feeding of the new board are performed during the same opening cycle. Periodically operating presses with one pressing gap are used for different pressing purposes of different boards, whereby in general also heating effect is exerted onto the board, besides the pressing effect. The heating effect can be implemented by means of heated pressure plates. One typical application of this kind is plating of boards with a film or the like. The board is in general a wood-containing board, like chipboard, batten-board or lattice-board, fiberboard or plywood. The invention also concerns an apparatus for implementing the method.

2. Description of Related Art

For the pressing purpose in question there is known a procedure, where the board to be pressed is fed, in a certain proceeding direction, into the immediate vicinity of the feeding side of the gap of the periodically operating press by means of a suitable conveyor, on which the board lies. On this area of readiness in the vicinity of the press, the board is gripped at its opposite side edges by gripping elements supported by feeding arms. The feeding arms form a first arm group, and they can be projected out to the grip distance from a vicinity of the guide bars supporting them. The guide bars extend continuously from the area of readiness past the opposite sides of the press, to the removing area of the pressed boards. Supported by the same guide bars there are also removing arms, the ends of which being equipped with gripping elements for gripping the pressed board in the opened gap of the press and for lifting it off from the lower pressure platen. The removing arms form the other arm group. After the removing arms have gripped to the board to be removed from the press, and respectively, after the feeding arms have gripped to the board to be pressed, the arms of the both groups are driven together in the removing, respectively in the feeding direction for a transfer path length, by which the pressed board can be removed from the press, and respectively, the board to be pressed can be fed into the open press gap. The feeding arms comprise elements for gripping the edge of the board by pressing. The removing arms, for their part, are equipped with elements for gripping to the surface of the board, primarily with suction pad elements. An apparatus using this procedure is disclosed, among others, in publication DE-A1-197 18 866.

EP-A1-0 908 282 discloses an apparatus, the operation of which follows the basic operations of the apparatus described above, that is, the board to be removed from the press is gripped at the upper surface, and the board to be fed to the press is gripped at the edges thereof by clamping. The gripping elements are supported by gripping arms, on which the gripping elements are movable in the transversal direction with respect to the transfer direction of the boards to be handled. Special for the construction described in this publication is that the movement of the groups of feeding arms and the groups of removing arms, respectively, in the transversal direction to the transfer direction of the boards can be implemented independently from each other. Prerequisite for achieving the described operations is, that the guides supporting the feeding and removing arms can be separated for achieving feeding and removing units, respectively, being movable in the direction perpendicular to the transfer direction of the board, independently from each other. It has been stated, that with the construction and the operation provided thereby, speeding up of the operating cycle can be achieved. The construction of the apparatus, however, does not provide moving of the boards in the operation direction of the apparatus so, that the feeding and removing movements of the boards could be staggered with respect to each other, which would be essential for speeding up the operation of the press.

This kind of staggering of the feeding and removing movements of boards is, on the other hand, possible with apparatus disclosed by U.S. Pat. No. A1 4,348,252 and U.S. Pat. No. A1 4,442,092.

In the above-mentioned disclosure, there is provided a feeding, removing carriage, to be driven into the opened gap of the press. The board to be pressed lies on top of a carriage to be driven into the gap, by which it is brought to the gap of the press, above the pressed board lying on the lower pressure plate. The lower side of the carriage is equipped with suitable surface gripping elements by which the pressed board can be gripped, when the carriage is driven to the gap, in order to lift it off from the lower pressure plate. After that the carriage is further driven out from the press, the pressed board hanging below the carriage. The board lying on top of the carriage and remaining to be pressed, for its part, is left supported only by edge supports, after the carriage has left the gap of the press. The board is lowered onto the lower pressure plate by drawing away the supports under the edges of the board. Prerequisite for the operation of the apparatus is, that the feeding and removing carriage performs a full-scale reciprocating movement in the transfer direction of the boards during the opening cycle of the press, which causes its own inevitable delay for the operation of the apparatus.

The removing and feeding device of a plate press, known from the above mentioned disclosure U.S. Pat. No. A1 4,424,092 is based on arms to be driven into the opened press gap from the side of the press, said arms supporting transfer and lifting means. The lifting means have been described as suction pad devices, for gripping to the pressed board, and by means of which it is lifted to the operation reach of suction transfer means supported by arms. With suction transfer device the board is then transferred away from the gap of the press. Supported by the arms there are provided also conveyor belts, on top of which the board to be pressed can be transferred to the gap of the press. The apparatus provides the removal movement of the pressed board independently from the feeding movement, and these movements can also be implemented staggered from each other. This makes it possible to speed up the operation of this device. One problem with this device is that both the feeding the removing devices are supported by the same arms, which is a constraint on performing the feeding and removing operations. One source of the problems is related to transporting the board set to the press in a loose state, supported on the conveyor belts. There is the risk that the laminating foil comes off during the quick feeding movement.

SUMMARY

In accordance with the present invention, the pressing cycle has been speeded up by a function, in which the movements of the feeding and removing arms for transferring the boards to be handled in the proceeding direction, are performed staggered with each other.

The characteristic features of the apparatus for performing the operations of the present invention are an apparatus for implementing a method for feeding a board to be pressed into a gap of a periodically operating press and for removing a pressed board from the gap of the press, wherein the board to be pressed is fed grip-supported into the gap of the press from one side and the pressed board is removed grip-supported from the same side or from an opposite side of the gap during an operation cycle of the press gap, wherein a movement performing the feeding operation of the board to the press and a movement for removing the board from the press are preformed at least partially staggered with each other. The apparatus includes feeding means of boards to be pressed for performing reciprocating movement, on opposite sides of pressure plates supported by guide bars. The apparatus also includes removing means of the pressed boards, wherein the removing means are extendable to a gripping contact with a respective board, and by the removing means the respective board can be lifted off a conveyor and lowered onto a heating plate of the press, lifted off the heating plate and lowered onto the conveyor. Supporting guides of the feeding means and removing means are separate from each other, that the guide bars of the feeding means and the guide bars of the removing means have been extended at the press to the reaching area of each other, and that the guide bars of the feeding means are located on a different level with respect to the guide bars of the removing means.

BRIEF DESCRIPTION OF THE DRAWINGS

The invention and its operation are disclosed in more detail in the following, with reference to the enclosed drawings, wherein.

DETAILED DESCRIPTION OF THE INVENTION

Figure 1:
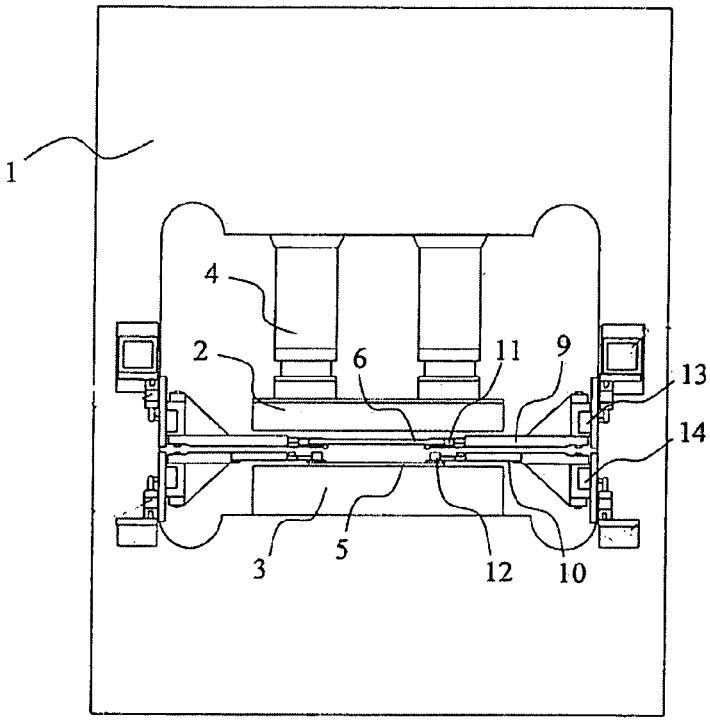
FIG. 1 shows a single-gap press equipped with feeding, respectively removing means following the operation principle of the invention, viewed from the end of the press.
Figure 2:
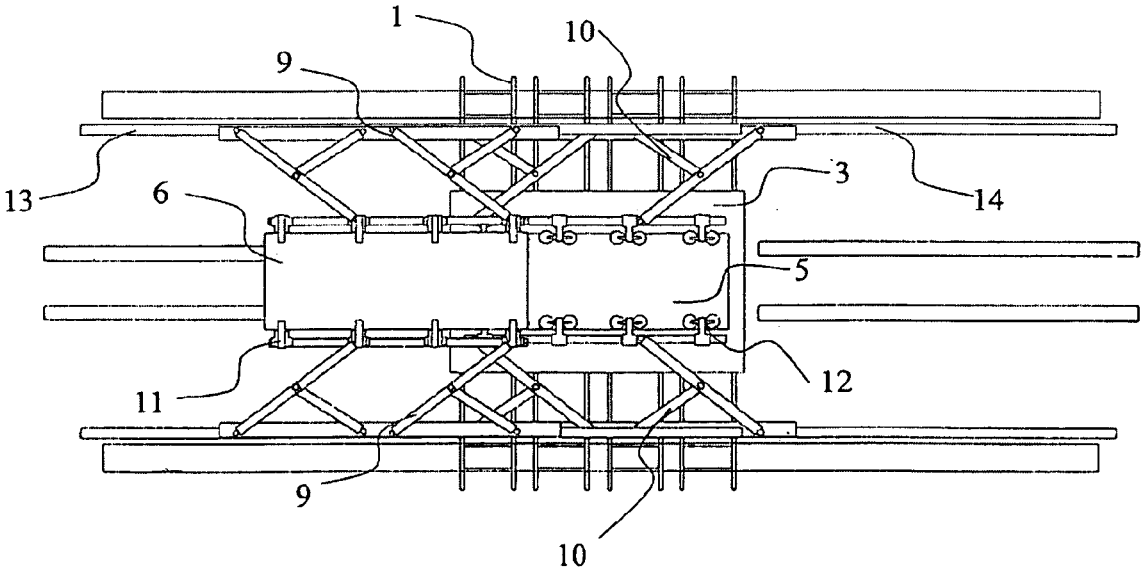
FIG. 2 shows a corresponding pressing apparatus as a top view, seen from the level of the press gap.

The press viewed from the end in FIG. 1 comprises as basic parts the frame 1 of the press, an upper press plate 2, a lower press plate 3 and press cylinders 4, by which the upper press plate is moved with respect to the lower press plate vertically. Reference number 5 shows a pressed board on top of the lower press plate, and respectively, reference number 6 shows a board to be brought to press. For feeding the board, the apparatus comprises feeding arms 9 operating at the opposite side edges of the press, and respectively removing arms 10. The feeding arms, respectively removing arms, form their own groups that are movable in the operating direction of the press line, on their own guide bars 13 and 14. The guide bars 13 for the feeding arms extend continuously from the gripping area of the board to be pressed substantially at the sides of the press for the length of the press, and the guide bars 14 for the removing device respectively extend continuously substantially at the sides of the press and further to the delivery area of the board. For providing the operation of the feeding device arms and the removing device arms so, that the movements of these arms for transferring the board in the operation direction of the press line can be staggered, the guide bars 13, 14 have been arranged on different vertical levels so, that the guide bars 13, on which the feeding device arms travel, are located on an upper level than the guide bars supporting the removing arms 14.

Figure 3:
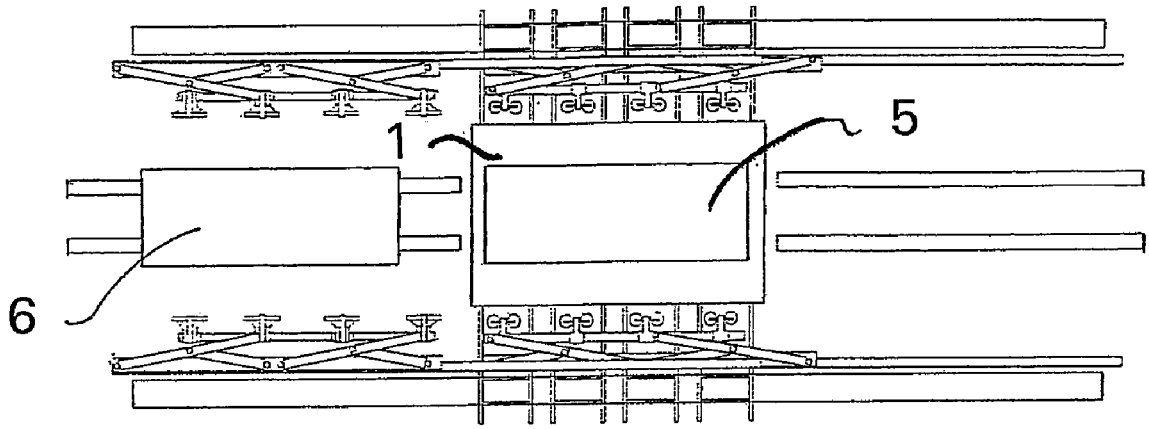
FIGS. 3-6 show different operation steps of the actual pressing apparatus.
Figure 4:
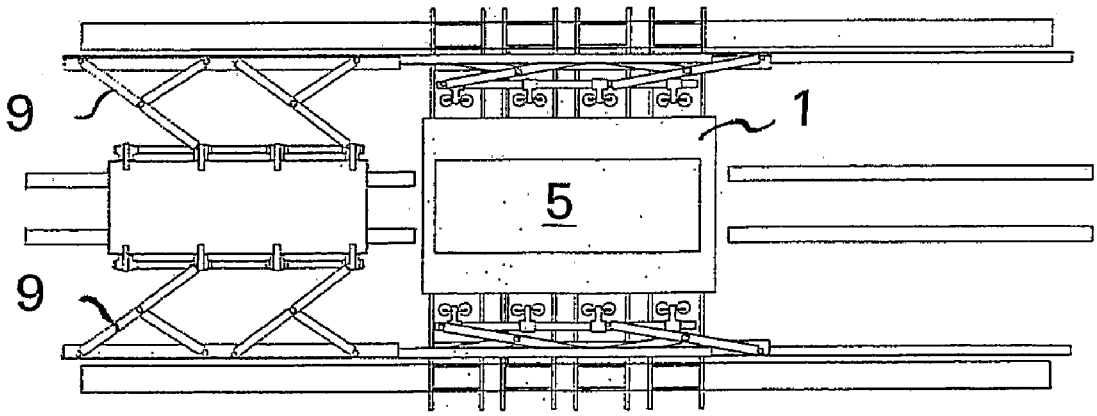
Figure 5:
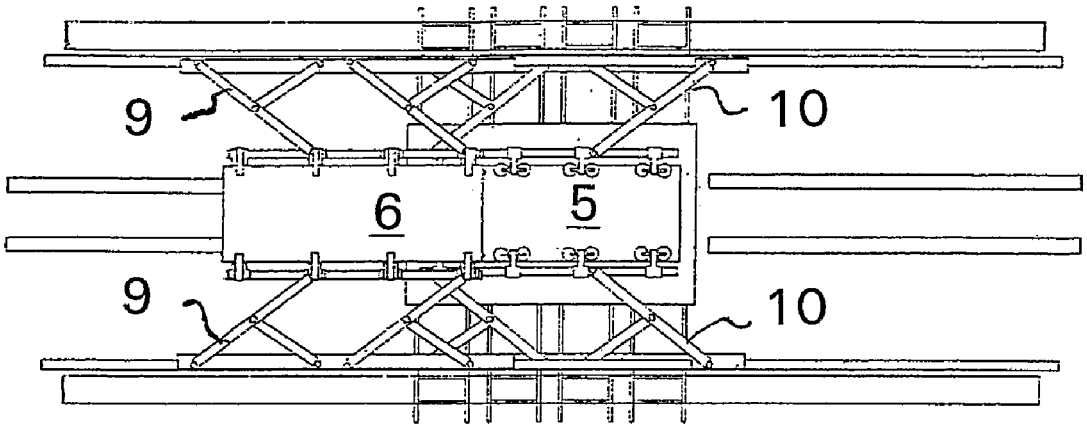
Figure 6:
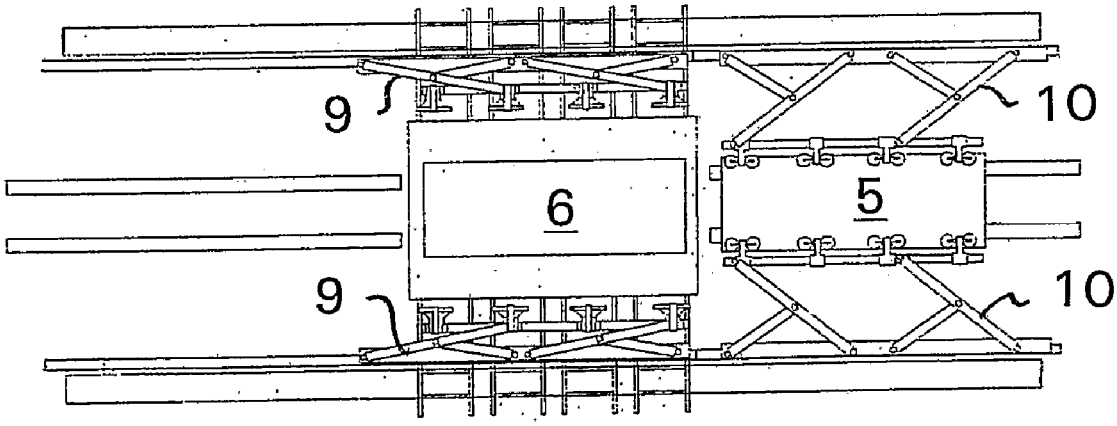

The operation principle and the advantages gained thereby can be visualized by means of schematic drawings from 3 to 6, related to the transferring steps of the boards:

FIG. 3 shows the starting situation of the pressing cycle, in which the board 6 to be pressed is waiting to be transferred to the press. The press 1 is closed and one board 5 is shown to be under pressing treatment inside the press 1. In the next operation step (FIG. 4), the feeding arms 9 are extended to the side edges of the board 6 to be pressed, and they grip the board by means of the clamps 11 for supporting it. The press 1 is in that phase still closed. When the press opens, the removing arms 10 are projected out to the gap of the press (FIG. 5), and the pressed board 5 is gripped by them at its upper surface by means of the suction pads 12 at the ends of the arms for supporting the board. After the press has opened, the board 6 supported by the feeding arms 9 can be transferred to the press gap while the removing arms 10 and the pressed board 5 still are in the gap. This situation can also be seen visualized in FIG. 1. This operation for its part speeds up the operation of the apparatus. Alternatively, the speed of the feeding movement of the feeding arms can be kept low, because a prolonged operation time has been achieved for their operation. This can be of advantage in quick-operated coating presses, in which a thin coating film is feed to the press on top of the board to be pressed.

The new board 6 can be lowered onto the lower pressure plate at the moment, when the previous board 5 has moved out of the press that much, that the board coming in can be lowered by the feeding arms 9 onto the pressure plate. After the board has been lowered, the feeding arms are released from the board and drawn out from the press gap.

After that the press is closed. The removing alms 10 hand out the ready board 5 and they are drawn to the vicinity of their guide bars. The feeding arms 9 and removing arms 10 are returned to the starting position of FIG. 3 for a new operation cycle. Returning of the removing arms 10 is preferably timed to the moment just before opening the press, so as to minimize the staying of the arms in the hot area of the press.

By means of the invention also a function is provided, wherein the pressed board is removed from the press on the same side as it was fed to be pressed.

Further, an operation principle of the apparatus can be provided, wherein the board to be pressed is brought to the press gap on a lower level than the level on which the board to be removed from the press is transferred out of the press gap.

The invention claimed is:

1. A method for feeding a board to be pressed into a gap of a periodically operating press and for removing a pressed board from the gap of the press, comprising:

feeding the board to be pressed grip-supported by clamping means into the gap of the press from one side; and removing the pressed board grip-supported from the same side or from an opposite side of the gap during an operation cycle of the press gap, wherein the movement for a feeding operation of the board to the press and a movement for removing the board from the press are performed at least partially staggered with each other; and the movement for the feeding operation of the board to the press is performed on an upper level vertically above a level of the movement for removing the board from the press.

2. An apparatus for implementing a method for feeding a board to be pressed into a gap of a periodically operating press and for removing a pressed board from the gap of the press, said apparatus comprising:

feeding means of boards to be pressed for performing reciprocating movement guide bars on opposite sides of pressure plates of the press, the feeding means are extendable to a gripping contact by a clamping means with a board to be pressed, for lifting said board off a conveyor and for lowering said board onto a heating plate of the press;

removing means of the pressed boards, for performing reciprocating movement on guide bars on opposite sides of the pressure plates, the removing means are extendable to a gripping contact with a respective board for lifting said board off the heating plate and lowering said board onto a conveyor and wherein the guide bars for the feeding means are located on an upper level vertically above a level of the guide bars for the removing means; and the guide bars for the feeding means and the guide bars for the removing means are extended at the press to a reaching area of each other.

* * * * *